US010480781B2

(12) United States Patent
Baugh et al.

(10) Patent No.: US 10,480,781 B2
(45) Date of Patent: Nov. 19, 2019

(54) REMOVAL OF CARBONACEOUS MICROBEADS

(71) Applicant: CONOCOPHILLIPS COMPANY, Houston, TX (US)

(72) Inventors: Thomas D. Baugh, Saline, MI (US); Edward G. Latimer, The Villages, FL (US); Stephen Appleyard, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 127 days.

(21) Appl. No.: 15/862,965

(22) Filed: Jan. 5, 2018

(65) Prior Publication Data

US 2018/0195713 A1 Jul. 12, 2018

Related U.S. Application Data

(60) Provisional application No. 62/444,992, filed on Jan. 11, 2017.

(51) Int. Cl.

| | |
|---|---|
| ***F22B 37/48*** | (2006.01) |
| ***F22B 29/06*** | (2006.01) |
| *F22B 35/10* | (2006.01) |

(52) U.S. Cl.

CPC ..... *F22B 37/486* (2013.01); *F22B 29/06* (2013.01); *F22B 35/10* (2013.01)

(58) Field of Classification Search

CPC ..... F22B 37/486

See application file for complete search history.

(56) References Cited

U.S. PATENT DOCUMENTS

| | | | | |
|---|---|---|---|---|
| 2009/0065440 | A1 | 3/2009 | Hicks et al. | |
| 2011/0089115 | A1 | 4/2011 | Lu | |
| 2012/0255904 | A1* | 10/2012 | Nagghappan | E21B 43/34 210/638 |
| 2012/0325744 | A1* | 12/2012 | Polizzotti | C02F 9/00 210/638 |
| 2013/0048877 | A1 | 2/2013 | Thoren et al. | |
| 2014/0151296 | A1* | 6/2014 | Moore | C02F 1/283 210/616 |
| 2014/0367095 | A1* | 12/2014 | Kolade | C02F 1/683 166/267 |
| 2015/0114318 | A1 | 4/2015 | Zhang et al. | |

(Continued)

OTHER PUBLICATIONS

International Search Report—PCT/US2018/012533 dated Mar. 9, 2018; 2 pgs.

*Primary Examiner* — Nathaniel Herzfeld
(74) *Attorney, Agent, or Firm* — ConocoPhillips Company

(57) ABSTRACT

A method for mitigating fouling in a once-through steam generator train is described. The method involves obtaining foulant samples from the once-through steam generator train. Obtaining water samples from one or more locations along the once-through steam generator train. Recovering filtered solids from the water samples from the one or more locations. Characterizing at least one physical property of the foulant samples and the filtered solids. Determining locations along the once-through steam generator train that include foulant precursor based on a matching of the at least one physical property between the foulant samples and the filtered solids. Installing an absorbent at locations that include the foulant precursor.

16 Claims, 4 Drawing Sheets

(56) References Cited

U.S. PATENT DOCUMENTS

| | | | | |
|---|---|---|---|---|
| 2015/0259232 | A1* | 9/2015 | Xia | C02F 9/00 166/267 |
| 2016/0137276 | A1 | 5/2016 | Salters et al. | |

* cited by examiner

REMOVAL OF CARBONACEOUS MICROBEADS

This application is a non-provisional application which claims benefit under 35 USC § 119(e) to U.S. Provisional Application Ser. No. 62/444,992 filed Jan. 11, 2017, entitled "REMOVAL OF CARBONACEOUS MICROBEADS", which is incorporated herein in its entirety.

FIELD OF THE INVENTION

The present invention relates to methods and systems for steam assisted gravity drainage. More particularly, but not by way of limitation, embodiments of the present invention include reducing or eliminating foulant precursors from once-through steam generators.

BACKGROUND OF THE INVENTION

Steam Assisted Gravity Drainage (SAGD) is an enhanced oil recovery technology for recovering heavy crude oil and bitumen. It is an advanced form of steam stimulation in which two parallel horizontal wells (one above the other) are drilled into the oil reservoir. High-pressure steam is continuously injected into the upper well which causes heated oil to gravity drain into the lower well and then pumped to the surface.

One of the challenges of SAGD is generating high quality steam. Because large amounts of water are needed for SAGD, water fed through the SAGD system is often recovered and recycled back as feedwater for additional steam generation. As expected, the recycled water can have many types of contaminants (suspended clays, free oil, dissolved organics, inorganics, etc.). Under certain conditions of temperature, pressure, and velocity, these contaminants will cause fouling in the heat exchanger and steam generator tubes, ultimately leading to steam generator failure. These interruptions to steam generations halt production.

Once-through steam generator (OTSG) is a type of steam generator that is used to generate the high quality steam needed for SAGD. Referring to FIG. 1, OTSG 10 includes a large, winding tube 20 in which feedwater is supplied at one end (inlet) and wet steam is produced at another end (outlet). Although the tube is continuous, it may be described as having an economizer section A (closest to the inlet), a superheater section C (closest to the outlet), and an evaporator section B located between the economizer and superheater sections. In the economizer section, temperature of the water is elevated close to the boiling point. Once the water reaches the evaporator section, it is converted into saturated steam. Lastly, the saturated steam is converted to superheated steam in the superheater section. A conventional OTSG boiler typically operates at around 80% steam and 20% blowdown water. The blowdown water contains salts and silica found in the water and produced from the reservoir.

Contaminants must be regularly removed from OTSG to ensure fouling does not occur frequently. Treatment of feedwater is needed to remove contaminants and protect steam-generating equipment. If contaminants are not removed, they can form solid masses that result in scale formation, fouling, and corrosion, among other problems. Precipitation of contaminants can deposit thermally insulating layers on heat exchange surfaces, causing boiler metals to eventually reach failure temperatures.

Piggings can physically remove solid contaminants from the OTSG. During low fouling periods, piggings may not be needed for several months. During high fouling periods, piggings may be required every month or so, leading to frequent costly interruptions in production. Each pigging event can easily cost millions of dollars.

BRIEF SUMMARY OF THE DISCLOSURE

The present invention relates to methods and systems for steam assisted gravity drainage. More particularly, but not by way of limitation, embodiments of the present invention include reducing or eliminating foulant precursors from once-through steam generators.

An embodiment of the present invention includes a method for mitigating fouling in a once-through steam generator train comprising: obtaining foulant samples from the once-through steam generator train; obtaining water samples from one or more locations along the once-through steam generator train; recovering filtered solids from the water samples from the one or more locations; characterizing at least one physical property of the foulant samples and the filtered solids; determining locations along the once-through steam generator train that include foulant precursor based on a matching of the at least one physical property between the foulant samples and the filtered solids; and installing an absorbent at locations that include the foulant precursor.

Another embodiment of the present invention includes a method for mitigating fouling in a once-through steam generator train comprising: obtaining solid foulant samples from the once-through steam generator train; obtaining water samples from one or more locations along the once-through steam generator train;

recovering filtered solids from the water samples from the one or more locations; characterizing the solid foulant samples and the filtered solids; determining locations along the once-through steam generator train that include foulant precursor based on a matching of the at least one physical property between the foulant samples and the filtered solids; and installing an absorbent at locations that include the foulant precursor.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
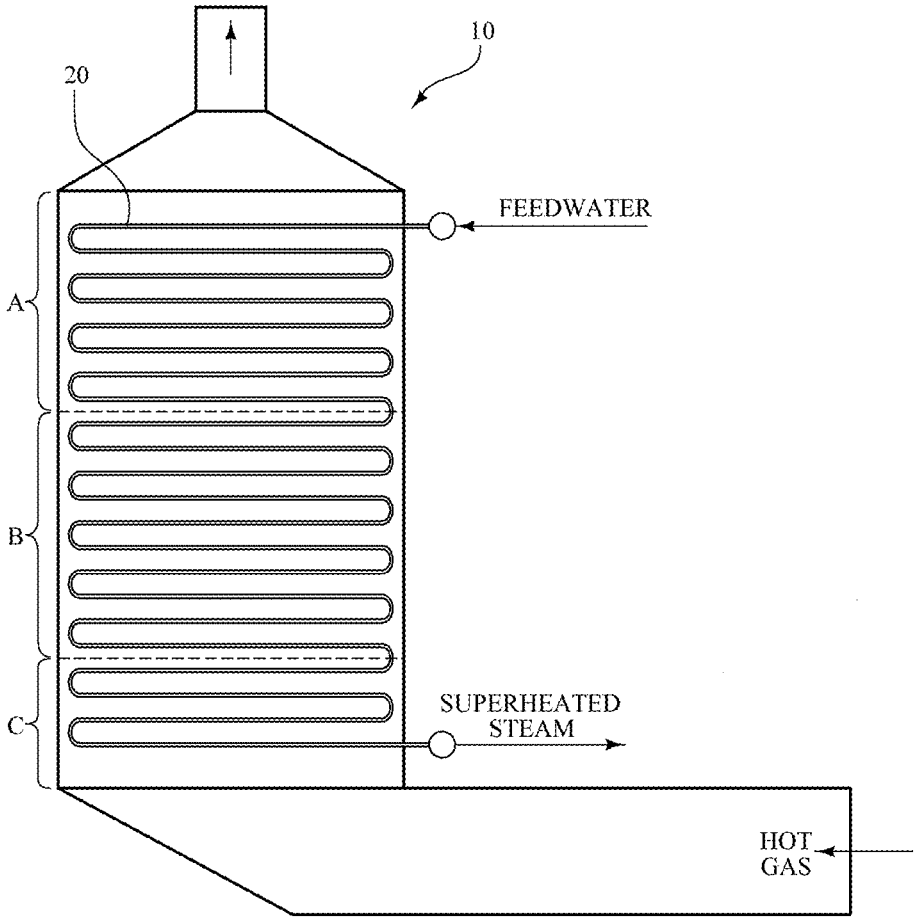
Fig. 1 (PRIOR ART)
FIG. 1 illustrates a conventional prior art once-through steam generator.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

OTSG fouling is a costly problem for SAGD operators. Sources of fouling (foulants) can be organic or inorganic. Organic-based OTSG fouling can occur as result of large polar organics in the feedwater co-precipitating with inorganics (e.g., Mg and/or silica to form Mg-silicates embedded in a carbon-rich organic matrix). This can form an insulating foulant deposit on the heat exchanging walls of the OTSG. To mitigate fouling, it is important to identify the source of fouling. In many cases, chemistry of the foulant must be characterized to devise an effective removal strategy.

It has been discovered that organic-based foulants may have precursors that can be captured before aggregating on heat exchanging surfaces. Typical organic-based fouling might be caused by dissolved phenolic compounds that are cycled up through the OTSG blowdown recycle in coupling reactions. As these compounds cycle around the system and grow in size, they ultimately reach a point where they come out of solution and deposit on OTSG tubes. One of the first places these foulants can aggregate is the inner tube wall in the lower economizer section of the OTSG where the first steam bubbles are produced.

The precursor of the organic foulants tend to be small (less than micron) microbeads. Some of the sub-micron impurities can contain oxygenated carbon mixed with Mg-silicates. It is likely that these impurities were formed from dissolved organics in the recycled water. The molecules "roll up" as microspheres by interfacial tension and may be either dissolved/soluble or possibly dispersed colloidally in the water.

OTSG fouling rates often correlate with rates of temperature increase on OTSG economizer shock and low finned tubes. This temperature rise usually goes hand in hand with pigging frequencies as tubes risk permanent damage if overheated. The more impurities and foulants in the feedwater, the quick the formation of boiler scaling which is insulating, translating in metal temperature rise and more greater pigging frequency.

The present invention provides methods and systems for mitigating fouling in OTSG boilers. More specifically, the present invention removes fouling precursors from OTSG boilers before they form as layers on the heat transfer surfaces. In some embodiments, the present invention provides adsorbent vessel(s) that target the small fouling precursors before they aggregate on heat transfer surfaces. The adsorbent vessel(s) can be installed in the water treatment train at SAGD processing facilities including different segments (e.g., economizer, evaporator, superheater) of the OTSG itself. A typical adsorbent vessel can include activated carbon, molecular sieve carbon, polymeric adsorbents and the like. The adsorbent vessel can be easily replaced without significant disruption of the OTSG boiler.

The adsorbent is a more economical method for removing ppm levels of submicron microbead precursor compared to filters that require huge amounts of area to avoid high pressure drop (at small micron rating). The use of adsorbents on water streams (e.g., medium pressure condensate) where the microbeads are concentrated would further reduce the size and cost of the adsorbent and vessel.

EXAMPLE

Figure 2:
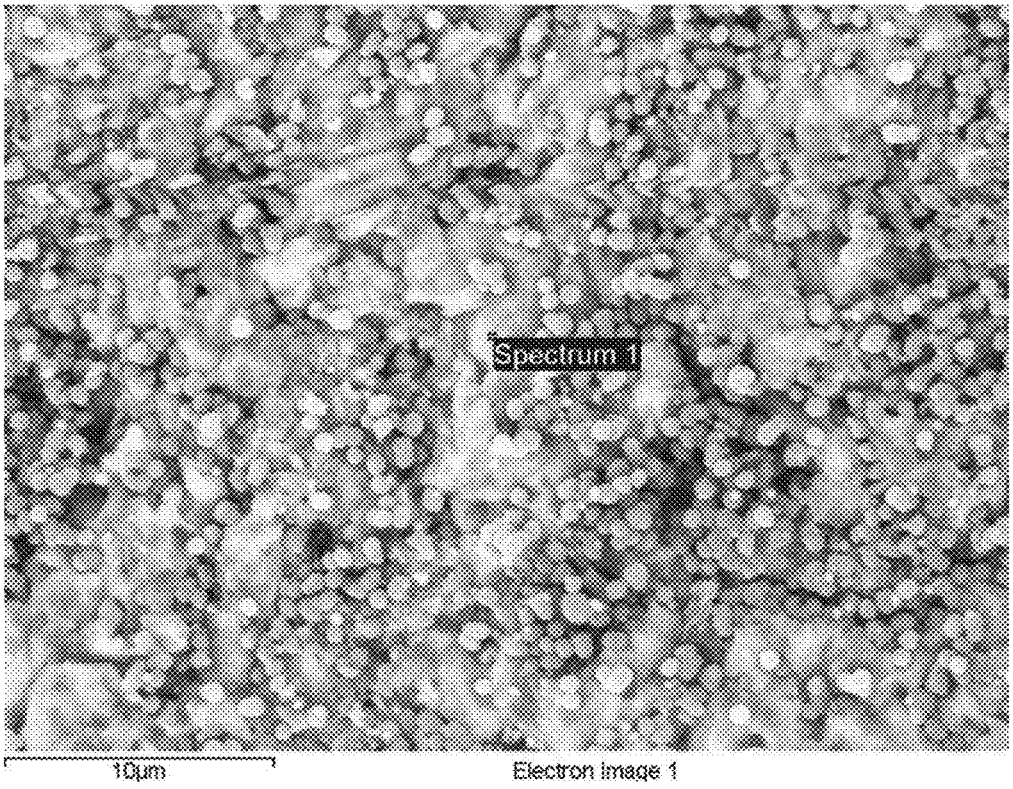
FIG. 2 shows a scanning electron microscope image of solids filtered from OTSG outlet.
Figure 3:
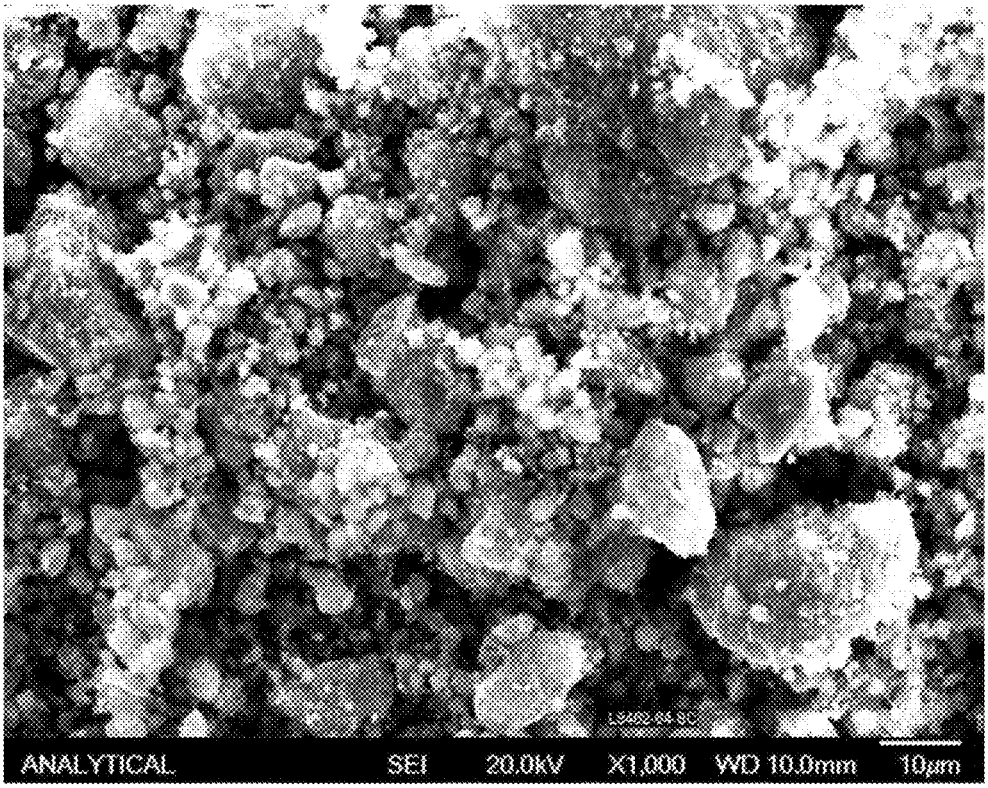
FIG. 3 shows a scanning electron microscope image of solids retrieved from pigging.

Solids were filtered from blowdown samples (obtained from a fouling OTSG) and analyzed by microscopy (FIG. 2). Analysis showed that the blowdown water contained particles that appeared to have similar morphology to carbon-rich pigging solids (FIG. 3). Mg and Si were found in roughly the same ratio as Mg-silicates in foulant. The elemental percentages of Mg and Si were lower than pigging solids because the C content of the blowdown solids. If these particles stuck to an OTSG tube wall and coked they could lose a significant amount of C, and the resulting compositions could approach pigging solids. Thus, these filterable blowdown solids are likely to be fouling precursor material that did not stick to the OTSG wall.

Interestingly, oxygenated organic microbeads were also found in blowdown solids mixed with Mg and Si containing material. Spherical microbeads were found in front-end water samples. Even though they are not likely present at process temperatures they are indicative of surface-active organic material that could cause front-end separation and fouling problems. The microbeads contain $O_2$ and C in a constant ratio which suggests that they are oxygenated hydrocarbons that started as dissolved organics in the water. They were 'rolled up' into spheres by interfacial tension and may be either dissolved/soluble or possibly dispersed colloidally in the water. These microbeads are not believed to be present at process temperatures but form only after cooling to room temperature. The spherical shape is indicative of surface-active organic material that would create problems for front-end separation. The fact that microscopy shows evidence of this surface-active material in the blowdown solids suggests it could be responsible for OTSG fouling.

Figure 4:
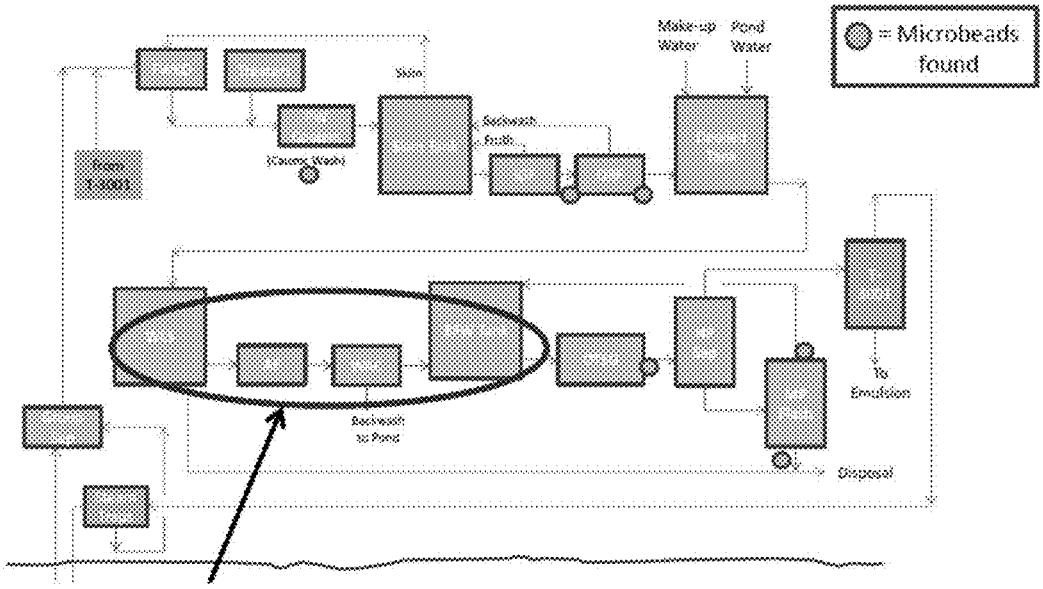
FIG. 4 schematically illustrates elements of steam generation system. The marked elements (green dot) show elements contaminated with foulant precursor microbeads.

FIG. 4 shows a schematic of a steam generation system. Each box represents an element. Elements tagged with green dot indicates that the foulant precursor microbeads were recovered in that element. These elements include OTSG, medium pressure (MP) flash, produced water (PW) coolers, induced gas flotation (IGF), and organic removal filter (ORF). Microbeads were not found in samples recovered inside the red circle. It is believed that either the higher pH kept the microbeads soluble, even after cooling to room temperature or the warm lime softner (WLS) removed some of the microbead-forming materials. Water sourced from each element along the steam generator system (i.e., OTSG train) may be tested for the microbeads.

It should be understood that FIG. 4 may not comprehensively illustrate each and every element of the steam generator system. While microbeads were not detected in other elements (e.g., FWKO or "free water knockout", HP sep or "high pressure separator", AF or "after filter", WAC or "weak acid cation exchange", BFW tank or "boiler feedwater tank") of the steam generator system in this Example, adsorbents can be easily installed in these elements should the need arise. Furthermore, each of these elements within the steam generator system are conventional and well-known to those of ordinary skill in the art.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for mitigating fouling in a once-through steam generator train comprising:

obtaining foulant samples from the once-through steam generator train;

obtaining water samples from one or more locations along the once-through steam generator train;

recovering filtered solids from the water samples from the one or more locations;

characterizing at least one physical property of the foulant samples and the filtered solids;

determining locations along the once-through steam generator train that include foulant precursor based on a matching of the at least one physical property between the foulant samples and the filtered solids; and installing an absorbent at locations that include the foulant precursor.

2. The method of claim 1, wherein the adsorbent is activated carbon or molecular carbon sieve.

3. The method of claim 1, wherein the absorbent is installed in the once-through steam generator, medium pressure flash, produced water cooler, induced gas flotation, or organic removal filter.

4. The method of claim 1, wherein the foulant precursor is made of carbon and silica.

5. The method of claim 1, wherein the foulant precursor is submicron in all dimensions.

6. The method of claim 1, wherein the foulant sample contains organic material.

7. The method of claim 1, wherein the characterizing includes determining chemistry of the foulant samples and filtered solids.

8. The method of claim 1, wherein the adsorbent is installed in economizer, evaporator, or superheater section of a once-through steam generator within the once-through steam generator train.

9. A method for mitigating fouling in a once-through steam generator train comprising:

obtaining solid foulant samples from the once-through steam generator train;

obtaining water samples from one or more locations along the once-through steam generator train;

recovering filtered solids from the water samples from the one or more locations;

characterizing the solid foulant samples and the filtered solids;

determining locations along the once-through steam generator train that include foulant precursor based on a matching of the at least one physical property between the foulant samples and the filtered solids; and installing an absorbent at locations that include the foulant precursor.

10. The method of claim 9, wherein the adsorbent is activated carbon or molecular carbon sieve.

11. The method of claim 9, wherein the absorbent is installed in the once-through steam generator, medium pressure flash, produced water cooler, induced gas flotation, or organic removal filter.

12. The method of claim 9, wherein the foulant precursor is made of carbon and silica.

13. The method of claim 9, wherein the foulant precursor is submicron in all dimensions.

14. The method of claim 9, wherein the foulant sample contains organic material.

15. The method of claim 9, wherein the characterizing includes determining chemistry of the foulant samples and filtered solids.

16. The method of claim 9, wherein the adsorbent is installed in economizer, evaporator, or superheater section of a once-through steam generator within the once-through steam generator train.

* * * * *